US006134749A

United States Patent [19]

Kuo

[11] Patent Number: 6,134,749

[45] Date of Patent: Oct. 24, 2000

[54] LUGGAGE EXTENSIBLE HANDLE ASSEMBLY PROTECTIVE DEVICE

[75] Inventor: Chung-Hsien Kuo, Taipei, Taiwan

[73] Assignee: Chaw Khong Technology Co., Ltd., Taipei County, Taiwan

[21] Appl. No.: 09/236,094

[22] Filed: Jan. 25, 1999

[30] Foreign Application Priority Data

Mar. 5, 1998 [CN] China ..... 87203184
Jul. 10, 1998 [CN] China ..... 98206745

[51] Int. Cl.[7] ..... A45C 7/00

[52] U.S. Cl. ..... 16/113.1; 280/655; 190/115

[58] Field of Search ..... 16/113.1, 405, 16/429; 190/115, 18 A, 15.1; 280/655, 655.1, 47.31, 47.315

[56] References Cited

U.S. PATENT DOCUMENTS 5,452,778 9/1995 Wang ..... 16/113.1
5,653,000 8/1997 Lee ..... 16/113.1
5,655,260 8/1997 Chang ..... 16/113.1
5,875,520 3/1999 Chang ..... 16/113.1

*Primary Examiner*—Chuck Y. Mah
*Attorney, Agent, or Firm*—Dougherty & Troxell

[57] ABSTRACT

A luggage extensible handle assembly protective device comprises a brace mounted on the luggage and a set of handle bars extensible in the two outer tubings which are attached to be brace. The set of extensible handle bars include a handle on the top and two extensible inner tubings at the bottom which can slide up or down in the outer tubings. The handle bars are characterized by a protective stop member at the bottom of each of the two inner tubings, which can prevent the lower portion of the inner tubing from deformation when the inner tubing is loaded with non-axial shear force during upward or downward movement, so as to ensure smooth slip of the inner tubing inside the outer tubing.

3 Claims, 5 Drawing Sheets

LUGGAGE EXTENSIBLE HANDLE ASSEMBLY PROTECTIVE DEVICE

BACKGROUND OF THE INVENTION

1. Field of the Invention

This invention generally relates to a luggage extensible handle assembly, and more particularly to a protective device of the inner tubing of the luggage extensible handle assembly.

2. Description of Related Art

As well know, luggage is becoming a necessary equipment for each traveler. It is usual for a traveler to take a luggage for flights or long distance traveling. Since most luggage is heavy and difficult to carry, wheels have been designed at the bottom of a luggage along with an extensible handle on the handle assembly for ease of carrying.

When the extensible handle of the handle assembly of a luggage is to be used, its inner tubing is pulled out to its maximum length, with the bottom end of its tubing locked in the top end of the outer tubing. While it is sometimes difficult for the user to judge the weight of the luggage, the user might not notice when the luggage is overloaded since the luggage is very easy to pull forward with the aid of the wheels installed at the bottom. When a luggage is to be moved, if it is overloaded, the inner tubing has to be pulled out by hand. Normally, there is certain amount of clearance between the inner tubing and outer tubing, when the luggage is moved along a rough road surface, the bottom end of the inner tubing might easily be deformed due to the significant torsion stress enforced by the outer tubing. And this can lead to the result that the extensible handle may become something unnecessary for handling of the luggage, since the handle of the luggage may not be able to extend inward or outward smoothly, or even be locked up. It is therefore necessary to provide a protection for the inner tubing of the extensible handle.

To solve this problem, the Taiwanese patent publication No. 270304 "an improvement of luggage extensible handle" has made improvement on the structural imperfection of the luggage, with improved structure illustrated in FIGS. 1 and 2. The improved structure includes a sleeve 76 at the bottom of the inner tubing, which has two barbs 761 inside. When the inner tubing is inserted into the sleeve 76, the two barbs 761 of the sleeve 76 would just hook into the locking hole 77 at the bottom end of the inner tubing 72, forcing the sleeve 76, and the inner tubing 72 to be united. The case is an excellent design concept, except that the sleeve 76 is inserted into the inner wall at the bottom end of the inner tubing 72. The barbs 761 are inserted into the locking hole 77 at the bottom of the inner tubing from inside out. It is well seen from the structure of the barbs 761 as shown in FIG. 2 that, the barbs 761 and the locking hole 77 of the inner tubing will easily separate once the two barbs 761 are slightly loaded with an axial or lateral force. In other words, the sleeve 76 installed in the inner tubing can not lock the inner tubing inside the sleeve 76 steadily, namely the sleeve 76 can not completely prevent the inner tubing from impact of external force. The bottom end of the inner tubing might easily be deformed. It is therefore necessary to improve the handle structure.

SUMMARY OF THE INVENTION

The main objective of this invention therefore is to provide a luggage extensible handle assembly protection device, which can mainly protect the bottom stop member of the inner tubing of the extensible handle assembly. The stop is held in position from outside in by the external wall of the inner tubing. The exterior of the stop member is again restrained by the inner wall of the inner tubing. This ensures the stop member of the inner tubing to remain and will not deform or deflect permanently. There will be no clearance between the external wall of the inner tubing and the internal wall of the external tubing. Therefore the inner tubing or the outer tubing will never deform or deflect even if loaded with external force.

Another objective of this invention is to provide a sort of luggage extensible handle assembly protective device, whose protective device can eliminate the difficulty of purchasing inner and outer tubings of the identical and exact specification without any clearance between the two. The inner and outer tubings used in this invention can be purchased directly from the market at inexpensive prices and with consistent quality, thus eliminating the need to store a large amount of inventory and significantly reducing production cost.

The above and other objectives of this invention are herein further explained with the help of the following drawings and preferred embodiments.

To be concise, identical or correlated codes have been assigned to identical or correlated parts pertained in the following explanation for cross reference.

DETAILED DESCRIPTION OF THE PREFERRED EMBODIMENTS

Figure 1:
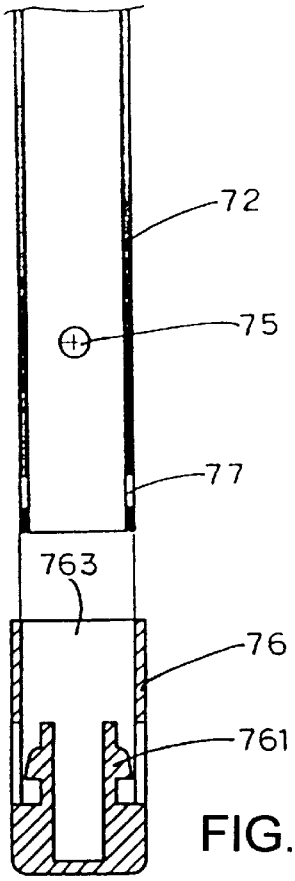
FIG. 1 (PRIOR ART)
FIGS. 1 and 2 are exploded views and assembled views of the device of the inner tubing of the conventional luggage extensible handle, respectively.
Figure 2:
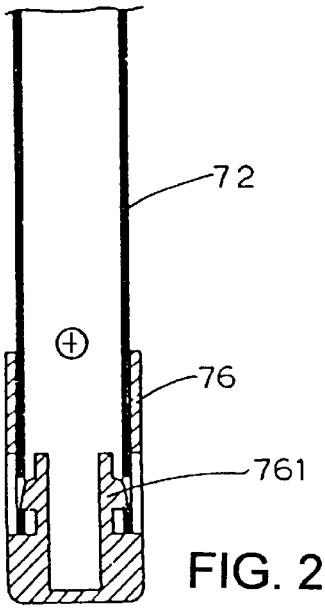
FIG. 2 (PRIOR ART)
Figure 3:
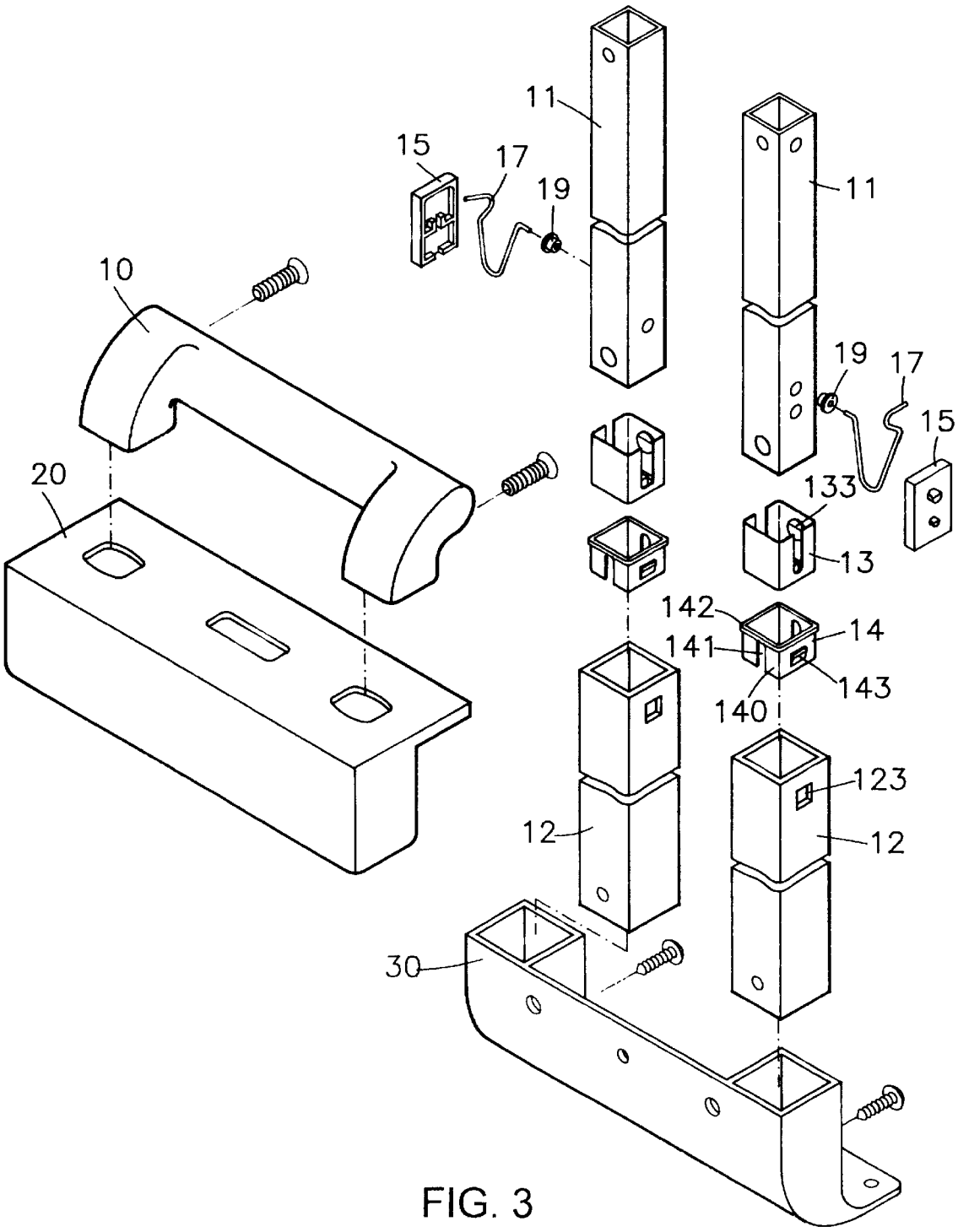
FIG. 3 is an exploded perspective view of the luggage extensible handle assembly of this invention.
Figure 4:
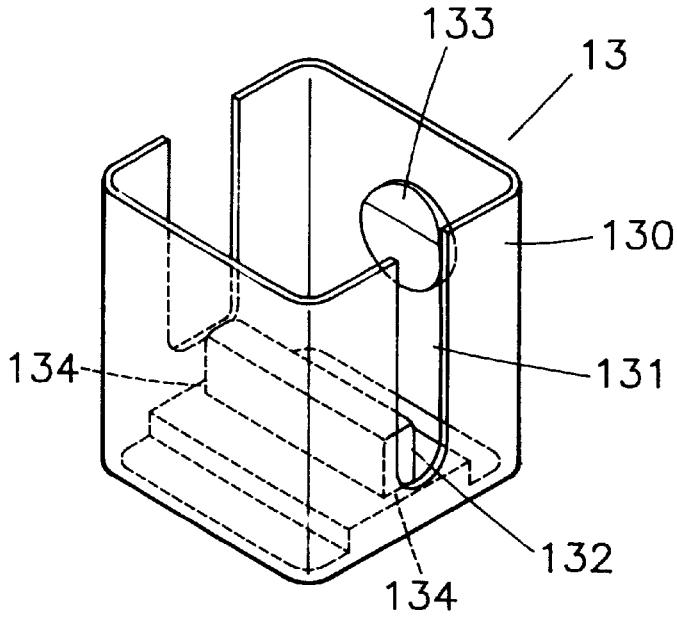
FIG. 4 is a perspective view of the protective device of the inner tubing of the luggage extensible handle assembly of this invention.
Figure 5:
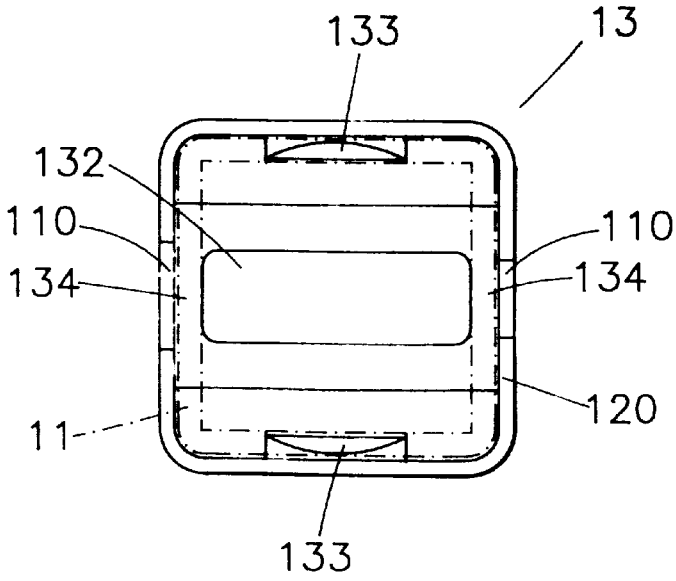
FIG. 5 is the plan view of the protective device of the inner tubing of the luggage extensible handle assembly of this invention.
Figure 6A:
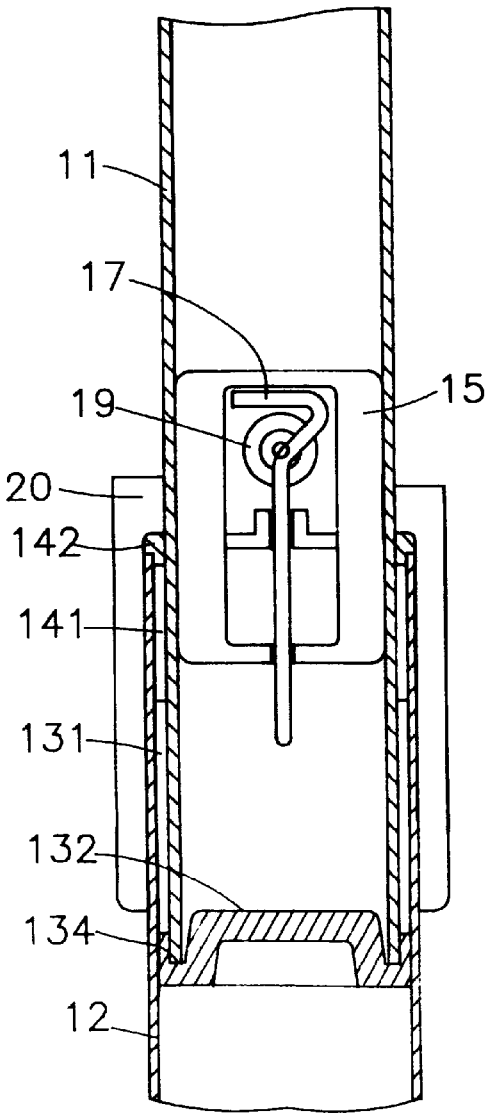
FIGS. 6A and 6B are the front and side views of the inner and outer tubings of the luggage extensible handle assembly at the fully extended condition of this invention, respectively.
Figure 6B:
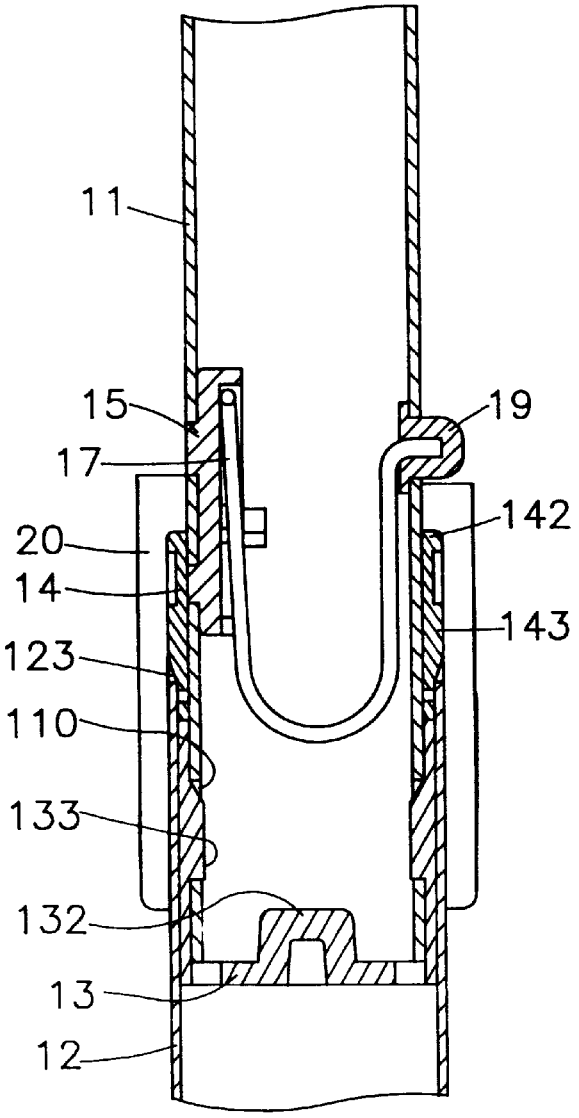

The structure of the luggage extensible handle assembly of this invention is illustrated in FIGS. 3, 4, 5 and further described below. Basically speaking, the extensible handle assembly of this invention comprises a brace 20 on the back of the luggage. Two square outer tubings 12 are mounted at the bottom of the brace. The ends of the two outer tubings 12 are mounted in the bracket 30. A handle 10 is mounted on the top of the inner tubings 11. The two inner tubings 11 are inserted inside the two outer tubings 12. A positioning lock device formed by a spring member 17 and a button 19 is mounted at the bottom end of the inner tubing 11. The spring member 17 can lock the inner tubing in position when it is extended to certain lengths, as shown in FIGS. 6A and 6B. The above mentioned luggage extensible handle assembly structure is not included in the present invention and thus will not be explained in further details. The protective device 13, which is the key point of this invention, will be described fully as shown in FIGS. 4 and 5. The protective device 13, (in the preferred embodiment may be a stop member) includes a stop member installed in the bottom end of the inner tubing 11. The stop member 13 includes a square frame formed by two U shape pieces 130. A U groove 131 penetrates through the two U shape pieces 130, making a room for the stop member 13 to be easily mounted at the bottom end of the inner tubing 11. The most important feature of the stop member 13 is that it is mounted between the exterior wall of the inner tubing 11 and the interior wall of the outer tubing 120 (as shown in FIG. 5). Once the stop member 13 is mounted at the bottom end of inner tubing 11, it is tightly locked between the inner and outer tubings, without any room to deform or deflect. The male member 132 designed at the bottom of stop member 13 locks the bottom of inner tubing 11 tightly inside the gap 134 between male member 132 and the interior wall of stop member 13. The male tabs 133 mounted on the interior walls of the two U shape pieces 130 of stop member 13 further locks inside the locking holes 110 of the inner tubings 11 tightly, This ensures that stop member 13 is firmly fixed at the bottom of the inner tubing 11 once it is locked in position.

Figure 7B:
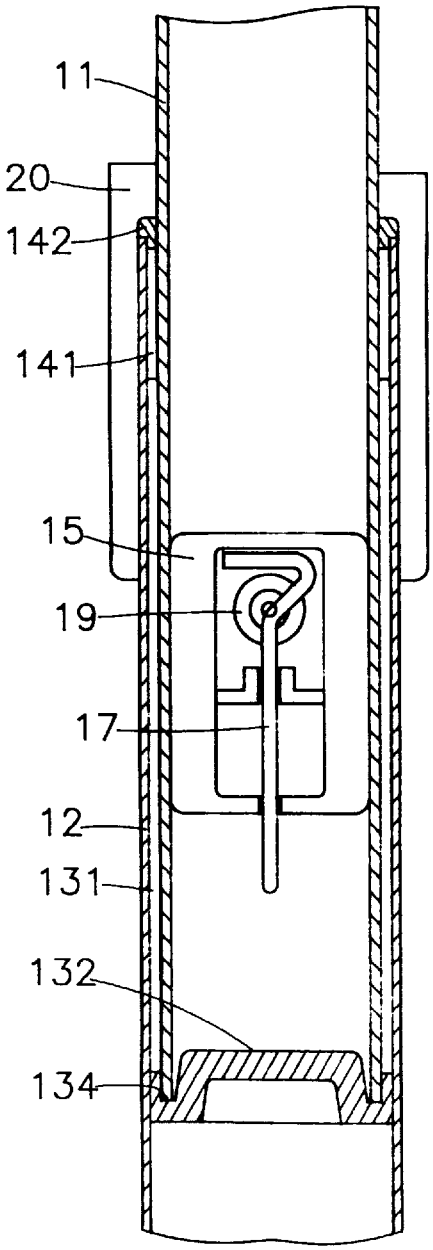
FIGS. 7A and 7B are the front and side views of the inner and outer tubings of the luggage extensible handle assembly at the fully retracted condition of this invention, respectively.
Figure 7A:
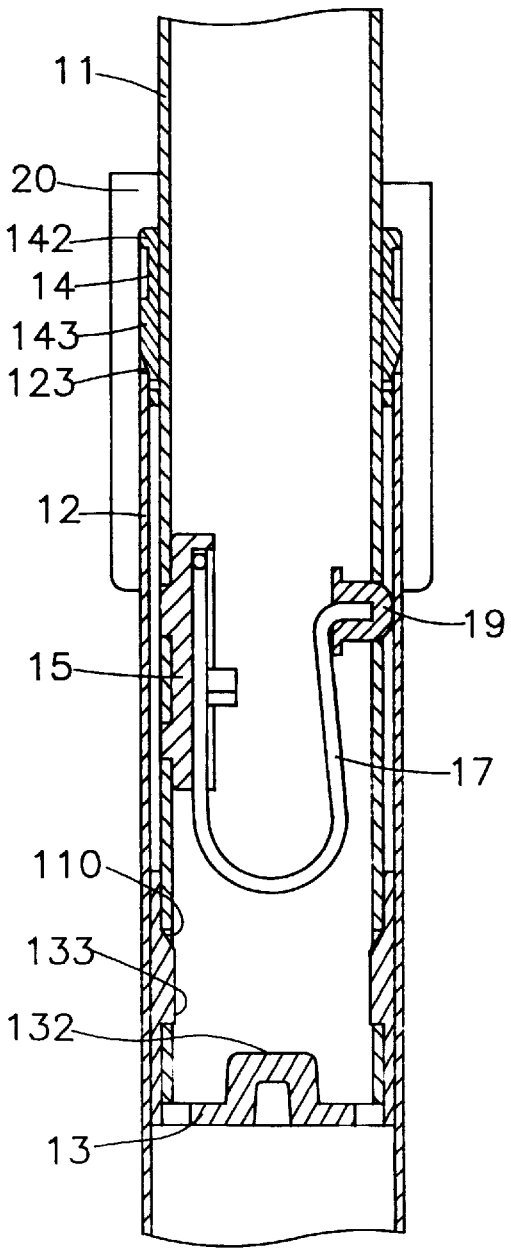

As mentioned above, the inner and outer tubings used in this invention are general products not made with exact precision, leaving a clearance between the inner and outer tubings. A tub 14 is therefore mounted on top of the outer tubing 12, as shown in FIGS. 3, 6 and 7. The structure of the tub 14 is shown in FIG. 3. It includes two U shape pieces 140 connected on the top. The square flange 142 is of the same size as the exterior wall of outer tubing 12. A square tab 143 is designed on the exterior wall of each U shape piece 140 to correspond with the square locking hole 123 on top of outer tubing 12. The tub 14 will tightly lock on the top of outer tubing once it is put on top of outer tubing 12. After the protective stop member 13 of the inner tubing 11 and the tub 14 of outer tubing 12 are mounted, the inner tubing is inserted into the outer tubing, and the stop member 13 is mounted after the bottom end of inner tubing 11 extends out of the bottom end of outer tubing 12. Then the tub 14 is mounted on top of outer tubing 12 and protective stop member 13 is mounted at the bottom end of inner tubing 11, making retraction and extension of the inner tubing inside the outer tubing smooth and firm. For details, please refer to FIGS. 6 and 7 where extended and retracted conditions are shown.

Based on the above mentioned description, the inner tubing protective device of the luggage extensible handle assembly structure of this invention includes a stop member 13 which can lock and retain outside the interior wall with its male tab 133 in the interior wall locked in position. The male member 132 at the bottom of stop member 13 further presses firmly the two interior walls 111 and bottom end 112 of the inner tubing. Refer to FIGS. 6B and 7B for details. Stop member 13 is fixed in position on the interior wall of outer tubing 12 without any room to deform or deflect. A tub 14 is further mounted on top of outer tubing. With the protective stop member 13, the inner tubing will extend or retract smoothly and tightly along the interior wall of the outer tubing without any room to deform or deflect, thus ensuring the protection when the inner tubing of the extensible bar slides inside the outer tubing. The protective stop member of the inner tubing of this invention is thus featured by unique spatial design, protective function for the luggage extensible handle assembly, as well as smooth and tight extension or retraction of the inner tubing inside the outer tubing, and should be considered as qualified for a patent of utility.

What is claimed is:

1. An extensible handle for luggage comprising:

a) a bracket attachable to the luggage;

b) first and second extensible tubing assemblies extending from the bracket, each extensible tubing assembly comprising:

i) an outer tubing extending from the bracket;

ii) an inner tubing movably located within the outer tubing, the inner tubing having a first end located within the outer tubing and a second end extending from the outer tubing;

iii) a stop member mounted on the first end of the inner tubing having a first portion located between the inner and outer tubings, a second portion extending inside the inner tubing including a male member forming a gap with the first portion into which a wall of the inner tubing is inserted; and iv) a tub mounted on an end of the outer tubing, the tub having a portion located between the inner and outer tubings;

c) a handle mounted on the distal ends of the inner tubings whereby the inner tubings are movable between a retracted position and an extended position determined by contact of the first portion of the stop member with the tub; and, d) a positioning lock device to releasably lock the inner tubings in the extended position.

2. The extensible handle of claim 1 wherein each extensible tubing assembly further comprises:

a) at least one locking hole in the inner tubing adjacent to the first end; and, b) at least one tab extending from the first portion of the stop member and engaging the at least one locking hole.

3. The extensible handle of claim 2 wherein each extensible tubing assembly comprises:

a) at least one second locking hole in the outer tubing; and, b) at least one second tab extending from the portion of the tub extending between the inner and outer tubings and engaging the at least one second opening.

* * * * *